United States Patent [19]

Jährig

[11] 4,056,236

[45] Nov. 1, 1977

[54] MACHINE FOR WINDING TEXTILE THREADS

[75] Inventor: Günter Jährig, Leopoldshafen, Germany

[73] Assignee: Industrie-Werke Karlsruhe Augsburg Aktiengesellschaft, Germany

[21] Appl. No.: 737,340

[22] Filed: Nov. 1, 1976

[30] Foreign Application Priority Data

Nov. 4, 1975 Germany ..... 2549254

[51] Int. Cl.[2] ..... B65H 54/20; B65H 17/08

[52] U.S. Cl. ..... 242/18 DD; 242/65

[58] Field of Search ..... 242/18 R, 18 DD, 65

[56] References Cited

U.S. PATENT DOCUMENTS

| | | | |
|---|---|---|---|
| 1,994,404 | 3/1935 | Reinefs | 242/18 DD |
| 3,575,357 | 4/1971 | Enneking | 242/18 DD |
| Re. 28,514 | 8/1975 | Enneking | 242/18 DD |

*Primary Examiner*—Edward J. McCarthy
*Attorney, Agent, or Firm*—McGlew and Tuttle

[57] ABSTRACT

A machine for winding textile threads, comprises a drive cylinder for driving at least one bobbin holder which is biased against the circumference of the drive cylinder. The bobbin holder is rotatably supported on a receiver which is guided along a horizontal guideway of a bobbin carriage. The receiver is urged by weight in a direction to cause engagement of the bobbin holder which receives the ball against the periphery of the drive cylinder. The receiver is movable continuously along the horizontal guide with an increase of ball volume as the winding proceeds. A swivel guide bar is pivotally mounted adjacent the guide and it is inclined relative to the horizontal and is pivotally movable in one direction and performs the slight pivotal movement during the horizontal displacement of the receiver. The receiver has a feeler roller in operative connection with the swivel guide bar and there is a second stationary feeler located adjacent the guide bar which is actuatable by the pivotal movement of the guide bar. The second feeler actuates drive means connected to the bobbin carriage for effecting the vertical displacement of the receiver with the ball when the swivel guide bar is pivoted.

5 Claims, 2 Drawing Figures

MACHINE FOR WINDING TEXTILE THREADS

FIELD AND BACKGROUND OF THE INVENTION

This invention relates in general to the construction of machines for winding textiles and, in particular, to a new and useful machine having means for supporting one or more bobbin holders in association with the circumference of a single drive cylinder and which includes means for guiding the receiver carrying the bobbin holder for horizontal movement and for displacement in a vertical direction when necessary.

DESCRIPTION OF THE PRIOR ART

The invention concerns a machine for winding textile threads, and particularly synthetic threads, and which includes several bobbin holders arranged on the circumference about a driving cylinder, which can be pressed against the latter to receive the balls. Means are provided for relative change of position and guidance of each bobbin holder with regard to the driving cylinder in an inclined plane, related to a horizontal extending through the center of the driving cylinder.

In known winding machines, the driving cylinder is brought at the start of the winding operation into frictional contact with the bobbin holder and with the tube attached on the latter. This results in acceleration of the bobbin holder and of the tube to the circumferential speed of the driving cylinder. The thread to be wound, which is fed at a constant speed from a delivery mechanism, is then conducted to the driving cylinder, placed on the tube, and "caught" or secured on the latter in a suitable manner.

With this process, which recurs with each winding of textile threads, etc., the so-called "bobbin journey" begins. The increasing circumference of the bobbin ball ensures that the center of the bobbin holder can move in a horizontal plane away from the driving cylinder, always maintaining frictional contact once it has been established. Such winding machines, however, no longer meet modern demands, since the size of the ball to be produced is relatively limited by the specific design of the machine.

In order to obtain a larger ball, corresponding to the requirements in practice, it has already been suggested to displace the bobbin holders in an inclined plane with regard to the horizontal extending through the center of the driving cylinder.

In DOS 2,220,856, it has been suggested, for example, in this connection, to secure the bobbin holder on a carriage. The latter moves during the bobbin journey on an inclined guide. A threaded spindle is required for moving the carriage which is arranged parallel to the spindle and receives its drive over a universal joint from a torque motor with reversible direction of rotation. Furthermore, tie rods are required, as well as a compensating cam disc to produce a tension acting on the carriage. The tension is produced by means of a roller spring arranged on a rotary housing.

From the foregoing considerations, it can be seen that two force systems are required for operating the suggested device, namely, a surface-pressure of a defined value to build up the bobbin ball, which represents the normal pressure of a friction drive at the starting movement between the driving cylinder and the cylindrical surface of the core former, for example, of an empty tube. The pressure also has an effect on the formation of the ball, that is, on its form and density.

The second force system serves to drive the carriage. During a bobbin journey, the weight of the ball increases by the constantly increasing circumference. This weight is a function of the path covered by the carriage during the winding operation. The gravitational force acting on the center of the bobbin holder thus rises constantly and increases the force vector extending parallel to the carriage guide toward the driving cylinder. In order to exclude an influence of this force vector on the surface pressure, the winding carriage is in equilibrium in the suggested machine by means of the above mentioned compensating cam disc, of the tie rods, and of the roller springs, in any position of the bobbin journey, if we assume the surface pressure with 0 kp.

In the suggested solution, the above mentioned compensating cam disc has the function of transforming the tension of the roller spring by varying the moments into the corresponding tension acting on the carriage and opposite to the force vector directed toward the driving cylinder.

When the carriage is in an equilibrium of forces by a properly selected compensating cam disc (different thread materials require different cam discs), the required surface pressure can be produced by the torque motor. The direction of rotation of the motor is so set that the direction of force of the threaded spindle points toward the driving cylinder. Since this is a motor with a variable and adjustable torque, the surface pressure can also be varied accordingly. In addition, the motor has the function of lifting the core former from the driving cylinder at the end of the bobbin journey, that is, to move the carriage into the end position and to apply the empty tube to the driving cylinder at the start.

Winding machines of the above-described type are relatively complex in their design and, therefore, not very cost-effective. Still, they have already shown in conceptional respect a first feasible way of producing larger bobbin walls.

SUMMARY OF THE INVENTION

Starting from this principle of inclined guidance of the bobbin carriage, found to be correct and advantageous, the present invention considerably improves such a carriage guidance by using different solution principles, thus reducing the costs. This is done by providing a receiver carrying the bobbin holder which is displaced continuously with increasing ball circumference parallel to the horizontal and which has a feeler roll in operative connection with a guide roller arranged in a relatively inclined position to the horizontal and unilaterally mounted for rotation. The guide roller performs a slight pivotal movement during the horizontal displacement of the receiver, and actuates over a stationary feeler a lifting cylinder starting the vertical movement of the receiver.

In an advantageous development of this basic idea of the invention, a carriage is provided which is displaceable in a vertical direction and which is connected with the lifting cylinder. The carriage also carries the guide means for the horizontal displacement of the receiver.

A further development of the invention is achieved by connecting the receiver elastically with a weight producing the surface pressure of the bobbin holder and the ball on the driving cylinder.

According to the invention, the feeler is an integral part of a control device for actuating the lifting cylinder. The control device can be operated selectively by pneumatic, hydraulic or electromagnetic means.

The invention has a number of advantages, for example, the inclined guide of the bobbin carriage is relatively simple in design; apart from purchased parts, and the inclined guide requires no precision parts. It is obvious that such designs have an effect on the production and, thus, on the sales prices which cannot be foreseen.

The simple design of the suggested inclined guide for the bobbin carriage was made possible by the fact that the displacement movement of the carriage, starting from the displacement of the angle direction relative to the horizontal passing through the center of the driving cylinder, was divided into two components, one of which effects the displacement in vertical direction. The control device necessary for operating the inclined bobbin carriage guide is not only simple in design, but it is also safe. It is based on the conventional and, therefore, proven, technique. In what manner, or with what medium, the control device is operated is of secondary importance, since media like compressed air, pressure oil or electric current are equally suitable without alternating anything in the control principle itself.

Accordingly, it is an object of the invention to provide a machine for winding textile threads, which comprises a drive cylinder havng means for supporting at least one or a plurality of bobbin holders on the circumference of the drive cylinder, which comprises a receiver having means for rotatably supporting a bobbin holder thereon, and a horizontal guide along which the receiver is movable, along with biasing means for biasing the receiver in a direction to urge the bobbin holder with the ball against the cylinder for rotation thereby and wherein the receiver is continuously displaceable along the guide with an increase of ball volume and which also includes a swivel guide bar pivotally mounted adjacent the guide for pivotal movement in one direction and performing the slight pivotal movement during the horizontal displacement of the receiver, and which includes a stationary feeler which is operable by the movement of the swivel guide bar to actuate drive means to effect the vertical displacement of the receiver.

A further object of the invention is to provide a device for winding textile threads which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 1:
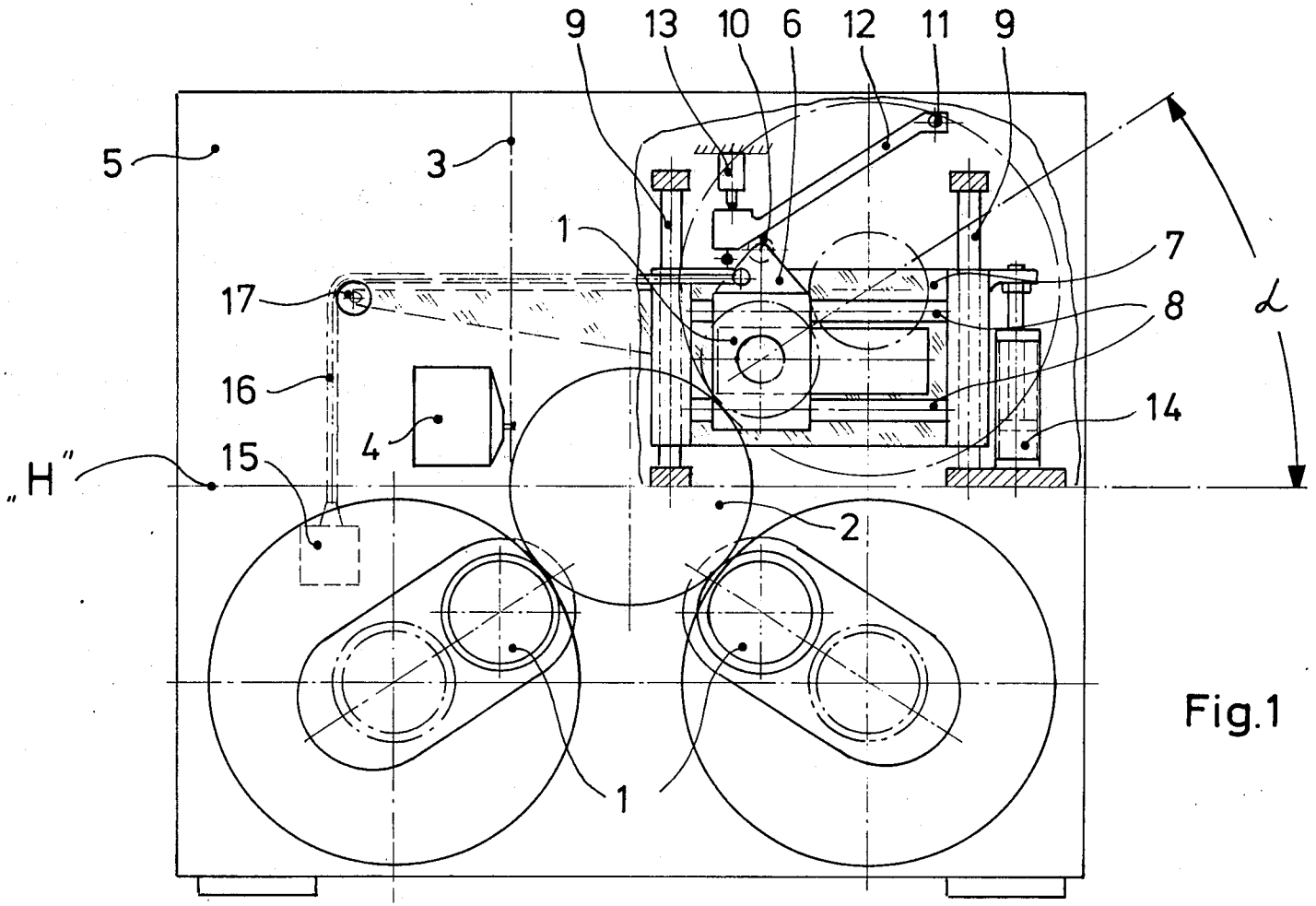
FIG. 1 is a schematic front elevational view of a winder constructed in accordance with the invention.

Referring to the drawings in particular, the invention embodied therein comprises a machine for winding textile threads which includes a plurality of bobbin holders 1 which are supported so that the holders with the ball may be pressed against the circumference of a common driving cylinder 2. The thread 3 arrives from a delivery mechanism, which is not shown, over the changing device 4 on driving cylinder 2, and from there, it is delivered to bobbin holder 1.

In order to be able to wind a maximum amount of thread material on the bobbin holders 1 and their tubes, each bobbin holder 1 is mounted in a certain angle to the horizontal "H" in a winder frame 5 which extends through the center of the driving cylinder.

Each bobbin holder 1 is rotatably mounted in a receiver 6 which is mounted for horizontal displacement on the guide means or rods 8, 8 arranged parallel to each other in bobbin carriage 7. The rods advantageously have a rotational symmetrical cross-section. Bobbin carriage 7 can be displaced in a vertical plane along guide means 9, e.g., stationary stey bolts. A feeler roller 10 on receiver 6 is operatively connected with swivel guide bar 12 which is rotatably mounted on pivot 11. A stationary feeler 13 is located adjacent bar 12. Feeler 13 is connected into a control device with a lifting cylinder 14, represented by way of example in FIG. 2. A weight 15 is connected with receiver 6 over a rope 16, which is conducted over a guide roller 17 and biases the receiver toward the drive cylinder.

The mode of operation of the inclined bobbin carriage guide is as follows:

At the start of the winding process, the tube (not shown), which is pushed over bobbin holder 1, bears on the circumference of the rotating driving cylinder 2 and is accelerated to its speed. The thread, supplied from the delivery mechanism over the changing device 4 is conducted about driving cylinder 2 and then is applied on the surface of the tube, where it is caught or secured.

With increasing formation of the ball, receiver 6 with bobbin holder 1 secured thereon, and the ball, is displaced on guide means 8 arranged in bobbin carriage 7 parallel to the horizontal "H" to the right, that is, away from driving cylinder 2. The indispensible frictional contact between driving cylinder 2 and the ball is maintained, however, in this process by weight 15.

Figure 2:
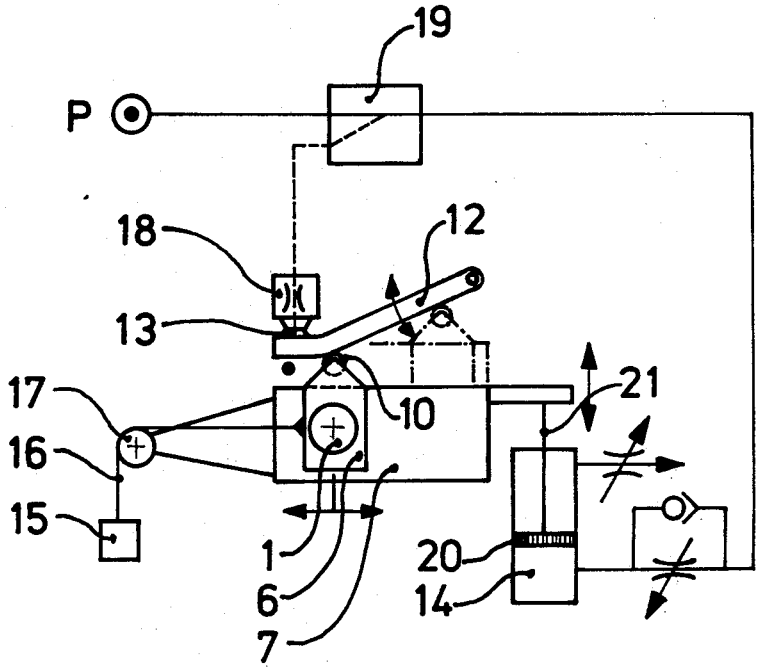
FIG. 2 is a schematic representation of a pnematic control device for the inclined bobbin carriage guide.

Due to the horizontal displacement of bobbin carriage 7, its feeler roller 10 is disengaged from the swivel guide bar 12. Because of the unilateral and freely rotating mounting of swivel guide bar 12, its free end has the tendency to be connected again with feeler roller 10. In this way, however, the operative connection existing between the free end of swivel guide bar 12 and stationary feeler 13 is interrupted. This interruption has the result that compressed air, pressure oil, etc., is supplied to an intensifier 19 over a Pitot tube 18 arranged behind feeler 13 (FIG. 2). The medium, which has been increased this way in its pressure, admits piston 20 of lifting cylinder 14. The resulting stroke of piston 20 is displaced over its piston rod 21 of bobbin carriage 7 guided by means of the stay bolts 9, together with receiver 6, bobbin holder 1, ball, etc., in a vertical direction upward so long until feeler roller 10 bears again on swivel guide bar 12 and the latter on feeler 13. When swivel guide bar 12 bears on feeler 13, the supply of the pressure medium is stopped.

The process of the horizontal and then vertical displacement of bobbin carriage 7 is repeated continuously during a bobbin journey. Naturally, all bobbin holders of a winding machine are actuated in the above described manner.

While a specific embodiment of the invention has been shown and described in detail to illustrate the application of the principles of the invention, it will be understood that the invention may be embodied otherwise without departing from such principles.

What is claimed is:

1. A machine for winding textile threads into a ball, comprising a drive cylinder, means for supporting at least one bobbin holder on the circumference of said drive cylinder comprising a receiver having means for rotatably supporting a bobbin holder thereon, a horizontal guide along which said receiver is movable, biasing means biasing said receiver in a direction to urge the bobbin holder which receives the ball against the drive cylinder for rotation thereby, said receiver being continuously displaceable along said guide with increased ball volume, a swivel guide bar pivotally mounted adjacent said guide and being inclined relative to the horizontal for pivotal movement in one direction and performing a slight pivotal movement in the horizontal displacement of said receiver, said receiver having a first feeler in operative connection with said swivel guide bar, a second stationary feeler located adjacent said guide bar and being actuatable by pivotal movement of said guide bar, and drive means connected to said receiver for effecting the vertical displacement thereof and connected to said second feeler for actuation thereof upon actuation of said second feeler.

2. A machine for winding textile threads, according to claim 1, wherein said guide includes a bobbin carriage mounted for displacement and having an opposite end, said carriage being connected to said drive means for displacing it along with said receiver to move said receiver vertically.

3. A machine for winding textile threads, according to claim 1, wherein said biasing means comprises a weight connected to said receiver.

4. A machine for winding textile threads, according to claim 1, wherein said second feeler is an integral part of a control device actuating said drive means, said drive means including a lifting cylinder and piston combination connected to said guide.

5. A machine for winding textile threads, according to claim 1, wherein said drive means comprises a fluid operated drive.

* * * * *